US007458365B2

(12) United States Patent
Hazama

(10) Patent No.: US 7,458,365 B2
(45) Date of Patent: Dec. 2, 2008

(54) FUEL SUPPLY SYSTEM WITH A COOLING PLATE

(75) Inventor: Tadashi Hazama, Chita-gun (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/785,137

(22) Filed: Apr. 16, 2007

(65) Prior Publication Data

US 2007/0246022 A1 Oct. 25, 2007

(30) Foreign Application Priority Data

Apr. 20, 2006 (JP) ..... 2006-116279

(51) Int. Cl.
*F02M 37/04* (2006.01)
*F02M 37/00* (2006.01)

(52) U.S. Cl. ..... 123/509; 123/514; 417/423.8

(58) Field of Classification Search ..... 123/509, 123/514; 417/423.3, 423.8
See application file for complete search history.

(56) References Cited

U.S. PATENT DOCUMENTS 5,080,077 A * 1/1992 Sawert et al. ..... 123/514
5,202,596 A * 4/1993 Jensen et al. ..... 310/64
5,345,124 A * 9/1994 Lang ..... 310/51
5,361,742 A * 11/1994 Briggs et al. ..... 123/506
5,454,697 A * 10/1995 Nakanishi ..... 417/423.3
5,593,287 A * 1/1997 Sadakata et al. ..... 417/366
5,697,769 A * 12/1997 Kobman et al. ..... 417/410.1
5,762,049 A * 6/1998 Jones et al. ..... 123/514
5,785,013 A * 7/1998 Sinn et al. ..... 123/41.44
5,908,286 A * 6/1999 Clemmons ..... 417/44.2
5,961,293 A * 10/1999 Clemmons et al. ..... 417/44.2
6,062,203 A * 5/2000 Takahashi et al. ..... 123/509
6,231,318 B1 * 5/2001 Cotton et al. ..... 417/423.1
6,296,458 B1 * 10/2001 Zacher et al. ..... 417/366
6,302,144 B1 * 10/2001 Graham et al. ..... 137/565.17
6,783,336 B2 * 8/2004 Kempfer et al. ..... 417/423.1
6,840,219 B2 * 1/2005 Joos et al. ..... 123/456
6,868,834 B1 * 3/2005 Mitani et al. ..... 123/495
6,886,542 B2 * 5/2005 Yamada et al. ..... 123/509
6,935,317 B2 * 8/2005 Wiesenberger et al. ..... 123/519
7,055,505 B2 * 6/2006 Washeleski et al. ..... 123/519
7,086,493 B2 * 8/2006 Knight ..... 180/274

(Continued)

FOREIGN PATENT DOCUMENTS

JP 62-035088 2/1987

(Continued)

*Primary Examiner*—Thomas N Moulis
(74) *Attorney, Agent, or Firm*—Nixon & Vanderhye PC

(57) ABSTRACT

A fuel supply system is disclosed that includes an electric fuel pump, a controller for controlling operations of the fuel pump, and a cooling plate that is disposed in the fuel tank and cools the controller by contacting the controller. Moreover, the system includes a fuel outlet device that allows for a flow of the fuel onto the cooling plate for heat exchange between the fuel and the cooling plate. A fuel supply system is also disclosed that includes a sub tank disposed in the fuel tank and a fuel pump that is disposed in the sub tank, increases a pressure of the fuel, and moves the fuel. Furthermore, the system includes a controller for controlling operations of the fuel pump and a cooling plate that is disposed in the sub tank and cools the controller by contacting the controller.

10 Claims, 5 Drawing Sheets

U.S. PATENT DOCUMENTS

| | | | | |
|---|---|---|---|---|
| 7,106,593 | B2 * | 9/2006 | Stabile et al. | 361/707 |
| 7,314,040 | B2 * | 1/2008 | Yagi et al. | 123/509 |
| 2005/0100461 | A1 * | 5/2005 | Izutani et al. | 417/423.8 |
| 2007/0253845 | A1 * | 11/2007 | Suzuki | 417/423.8 |

FOREIGN PATENT DOCUMENTS

| | | |
|---|---|---|
| JP | 07-293397 | 11/1995 |
| JP | 2001-099029 | 4/2001 |
| JP | 2004-137986 | 5/2004 |

* cited by examiner

FUEL SUPPLY SYSTEM WITH A COOLING PLATE

CROSS REFERENCE TO RELATED APPLICATION

The following is based on and claims priority to Japanese Patent Application No. 2006-116279, filed Apr. 20, 2006, which is hereby incorporated by reference in its entirety.

FIELD OF THE INVENTION

This invention relates to a fuel supply system and, more particularly, to a fuel supply system with a cooling plate.

BACKGROUND OF THE INVENTION

Various fuel supply systems are proposed in the prior art. For instance, JP-A-H07-293397, JP-A-S62-35088, JP-A-2001-99029, JP-A-2004-137986, and others disclose a fuel supply system that supplies the fuel in the fuel tank to an internal combustion engine via an electric fuel pump. In JP-A-H07-293397, for instance, a controller electrically controls operation of the fuel pump. It is necessary to cool the controller because electronic parts mounted on the controller, such as a power transistor, generate heat.

Conventionally, the controller is equipped with a cooling fin for air cooling. More specifically, the cooling fin is provided on an external surface of a lid member of the fuel tank. Also, the cooling fin is provided between the fuel tank and a car body member. However, if the clearance between the fuel tank and the car body member is small, the cooling fin may be smaller, which disadvantageously reduces the cooling capability of the controller.

In partial response to this problem, systems have been proposed that include a cooling structure for cooling the controller with the fuel instead of via air cooling. For instance, JP-A-S62-35088 and JP-A-2001-99029 disclose this type of system.

More specifically, JP-A-S62-35088 discloses a structure in which the controller contacts the external surface of a metallic lid member, and a cooling fin is included that is capable of exchanging heat with the fuel. The cooling fin is provided on the inside of the lid member, and the cooling fin is cooled by the fuel. As such, the lid member is interposed between the controller and the cooling fin, and accordingly cooling capability may be insufficient. More specifically, if the lid member is made of a resin, the cooling capability decreases considerably because the resin has low thermal conductivity.

Furthermore, JP-A-2001-99029 discloses a structure in which a metallic cooling plate contacting the controller is provided, and the cooling plate is insert-molded with resin so as to be formed coupled to and around a resin-made fuel pipe through which the fuel circulates. Thus, the cooling plate is cooled by the circuiting fuel. As such, the resin-made fuel pipe is interposed between the circulating fuel and the cooling plate, and accordingly the cooling capability may be decreased.

SUMMARY

A fuel supply system is disclosed for supplying fuel in a fuel tank to an internal combustion engine. The fuel supply system includes an electric fuel pump for increasing a pressure of the fuel and moving the fuel. The system also includes a controller for controlling operations of the fuel pump and a cooling plate that is disposed in the fuel tank and cools the controller by contacting the controller. Moreover, the system includes a fuel outlet device that allows for a flow of the fuel onto the cooling plate for heat exchange between the fuel and the cooling plate.

A fuel supply system is also disclosed for supplying fuel in a fuel tank to an internal combustion engine. The fuel supply system includes a sub tank disposed in the fuel tank and a fuel pump that is disposed in the sub tank, increases a pressure of the fuel, and moves the fuel. Furthermore, the system includes a controller for controlling operations of the fuel pump. Also, the system includes a cooling plate that is disposed in the sub tank and cools the controller by contacting the controller.

DETAILED DESCRIPTION

Hereafter, a plurality of embodiments of this invention will be described based on the drawings.

First Embodiment

Figure 1:
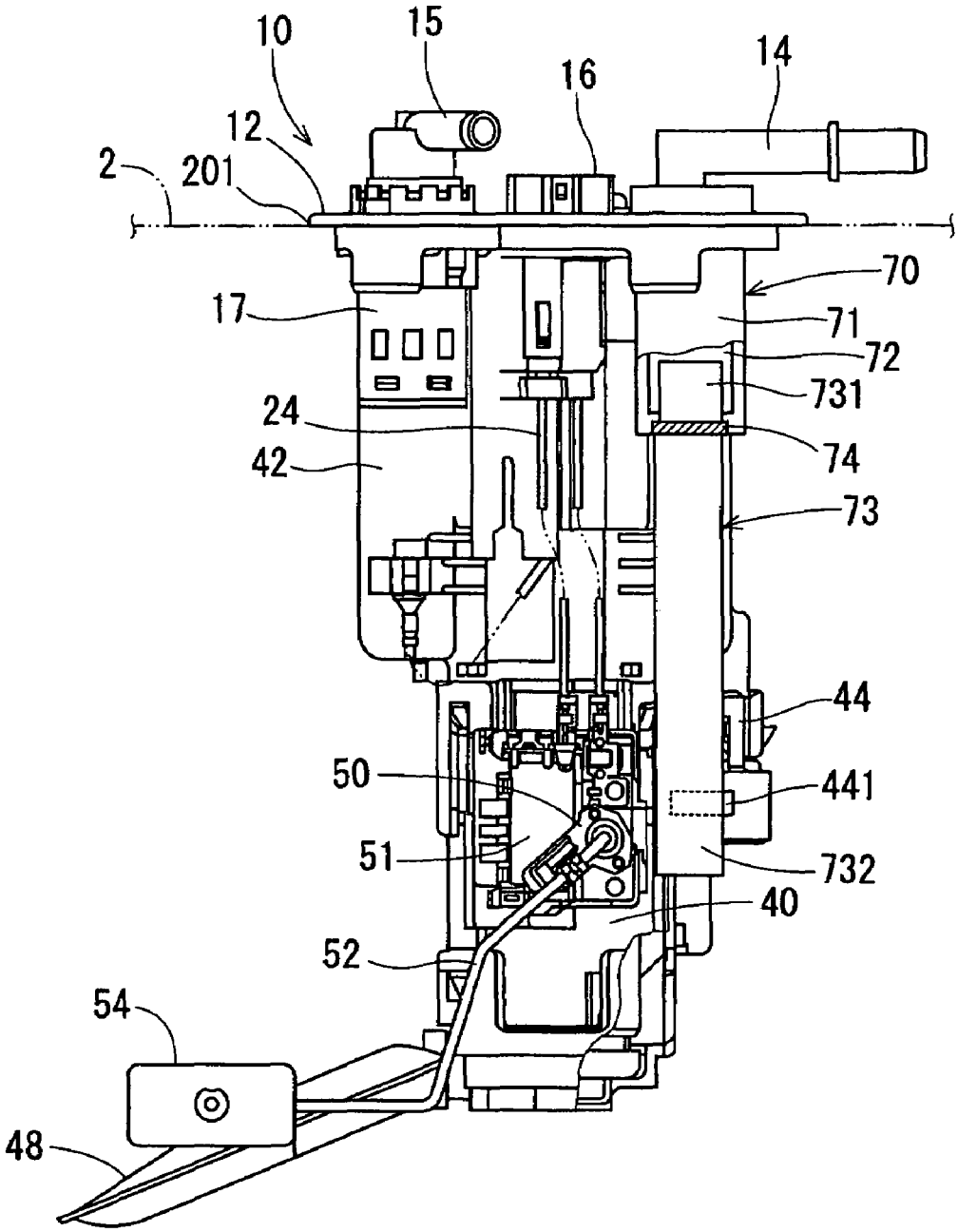
FIG. 1 is a front view of a first embodiment of a fuel supply system.
Figure 2:
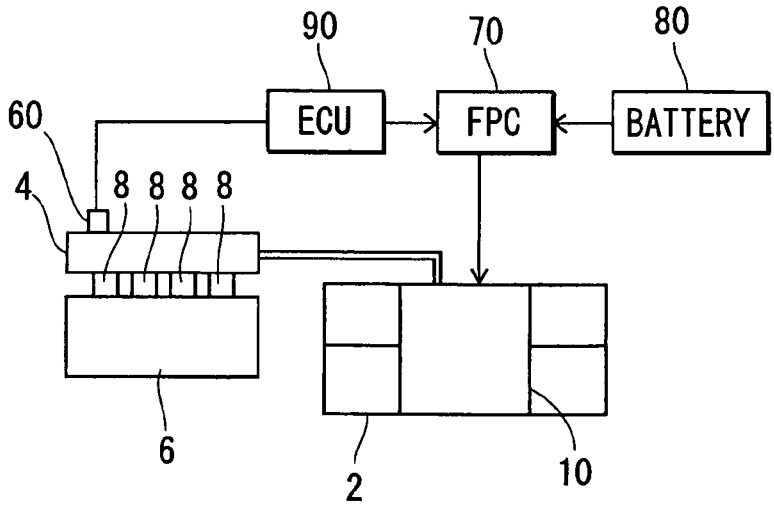
FIG. 2 is a schematic illustration of the fuel supply system of FIG. 1.
Figure 3:
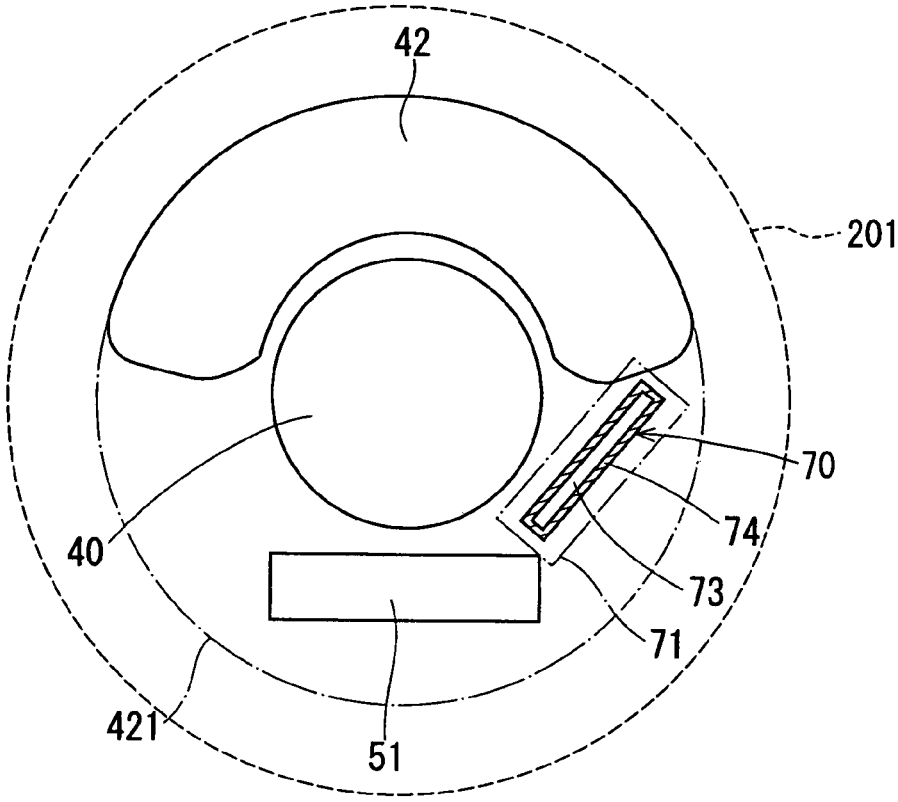
FIG. 3 is a longitudinal projection view of the fuel supply system of FIG. 1.

FIGS. 1 to 3 show a fuel supply system according to a first embodiment. The fuel supply system consists of a pump module 10, a fuel pump controller 70 ("FPC"), and other constituent elements as shown in FIG. 2.

The pump module 10 is coupled to a fuel tank 2. The pump module 10 increases a pressure of the fuel in the fuel tank 2, and moves the fuel to supply the fuel to a delivery pipe 4. A pressure sensor 60 (i.e., a fuel pressure detecting device) is operatively coupled to the delivery pipe 4 and detects the pressure of the fuel in the delivery pipe 4. The pressure sensor 60 outputs a detection signal of the fuel pressure to an ECU 90. Fuel injection valves 8 are operatively coupled to the delivery pipe for supplying fuel to respective cylinders of an internal combustion engine 6.

The FPC 70 is supplied electric power from a battery 80 and controls driving signals of a fuel pump 40 (see FIG. 1) of the pump module 10. The FPC 70 also controls a discharge pressure of the fuel pump 40. The FPC 70 controls the driving signal of the fuel pump 40 to control discharge pressure of the fuel pump 40 based on an instruction signal from the engine control unit 90 ("ECU") for providing an optimal fuel pressure that corresponds to an operating state of the internal combustion engine 6. In other words, various sensors (not shown) input signals corresponding to the operating state of the engine to the ECU 90 so that the amount of injection of the fuel injection valves 8 is controlled based on the operating state of the internal combustion engine. Moreover, detection signals including information of the fuel pressure detected by the pressure sensor 60 are inputted into the ECU 90.

Next, the fuel supply system will be explained in detail.

As shown in FIG. 1, the FPC 70 is coupled to the pump module 10 such that the FPC 70 and the pump module 10 can be installed as a unit in which the two constituent elements are integrated.

The pump module 10 includes a flange 12 serving as a lid member, the fuel pump 40, a fuel filter 42, a suction filter 48, etc. The pump module 10 is of an in-tank type wherein components other than the flange 12 are housed in a fuel tank 2.

The flange 12 is made of a resin. The flange 12 is a disc that covers a circular opening 201 formed in the upper wall of the fuel tank 2. A fuel discharge pipe 14, a fuel vapor outlet pipe 15, a fuel vapor control valve 17, an electric connector 16, the FPC 70, etc. are coupled to the flange 12. Among these members, the fuel discharge pipe 14, the fuel vapor outlet pipe 15, and the electric connector 16 are coupled to an upper and outer side of the flange 12. The fuel vapor control valve 17 and the FPC 70 are coupled to the lower and inner side of the flange and are provided inside the fuel tank 2.

The fuel discharge pipe 14 is connected with the fuel pump 40 via a pipe. As such, supply fuel is increased in pressure by the fuel pump 40 and foreign substances are removed by the fuel filter 42 and then are discharged outside of the fuel tank 2 by the fuel discharge pipe 14. A pressure regulator 44 is also operatively provided in the fuel tank 2 and between the discharge port of the fuel pump 40 and the fuel discharge pipe 14. The pressure regulator 44 discharges a portion of the fuel that the fuel pump 40 discharges from a drainage port 441 when the discharge pressure of the fuel pump 40 exceeds a predetermined pressure. As such, the discharge pressure of the fuel pump 40 is adjusted.

The electric connector 16 is electrically connected with the fuel pump 40 and a fuel gauge 50 by lead wire 24.

The fuel vapor outlet pipe 15 couples the inside of the fuel tank 2 and a canister (not shown) outside the fuel tank 2. The fuel vapor control valve 17 is operatively coupled to an end the fuel vapor outlet pipe 15. When the pressure inside the fuel tank 2 becomes larger than the predetermined value, the fuel vapor control valve 17 opens. This allows the fuel vapor produced inside the fuel tank 2 to be discharged into the canister, and accordingly the pressure inside the fuel tank 2 decreases. The vapor of the fuel passed through the fuel vapor control valve 17 flows out of the fuel tank 2 into the canister. For example, when fuel is fed into the fuel tank 2, the fuel vapor control valve 17 opens, and fuel vapor that would be otherwise pushed outside of the fuel tank 2 by refueling is adsorbed by the canister.

Incidentally, instead of the fuel vapor control valve 17, a float valve may be provided that blocks a passage when the fuel fed into the fuel tank. When fueling, the float valve blocks the passage, which forbids air from being discharged from the fuel tank 2 to the outside, and fueling is halted.

The fuel gauge 50 is mounted on the peripheral wall of the fuel pump 40. The fuel gauge 50 has a sender gage 51, an arm 52, and a float 54. The float 54 is linked to the arm 52. The float 54 moves up and down in response to a remaining quantity of the fuel, thereby rotating the arm 52, and the sender gage 51 detects the remaining amount of the fuel tank 2 based on the turning position of the arm 52. A corresponding detection signal is outputted to the FPC 70 through the lead wire 24.

The FPC 70 is attached on the inside of the fuel tank 2 of the flange 12, and is electrically connected with the electric connector 16. A CPU, ROM, etc. are mounted on the FPC 70. The CPU of the FPC 70 controls the driving signal of the fuel pump 40 by executing a control program stored in the ROM. The FPC 70 controls the discharge pressure of the fuel pump 40 by adjusting a duty ratio of a driving voltage impressed to the fuel pump 40. When the duty ratio of the driving voltage impressed to the fuel pump 40 increases, the discharge pressure of the fuel pump 40 will increase. When the duty ratio of the driving voltage impressed to the fuel pump 40 decreases, the discharge pressure of the fuel pump 40 will decrease.

The discharge pressure control of the fuel pump 40 by the FPC 70 will be explained more concretely. First, the ECU 90 outputs an optimal target pressure to the FPC 70 depending on an operating state of the internal combustion engine and the detection signal from the pressure sensor 60. Next, the FPC 70 sets a target combustion pressure to the pressure output by the ECU 90, and alters the duty ratio of the driving voltage output to the fuel pump 40 so that the combustion pressure inside the delivery pipe 4 detected by the pressure sensor 60 may approach the target pressure. Through such a duty control, the discharge pressure of the fuel pump 40 is controlled by the FPC 70.

Next, a cooling structure of the FPC 70 will be explained using FIGS. 1 and 3.

The FPC 70 has a circuit board 72 with electronic parts (not shown) mounted thereon, such as a power transistor. The FPC 70 also includes a resin-made case 71 for housing the circuit board 72, and a metallic cooling plate 73 contacting the circuit board 72. In one embodiment, the cooling plate 73 is made of a material having corrosion-resistance to the fuel and having heat radiation capability. For example, in one embodiment, the cooling plate 73 is made of aluminum. The cooling plate 73 has a contact part 731 that is provided inside the case 71 and contacts the circuit board 72 and a heat radiation part 732 provided outside the case 71.

The heat radiation part 732 is provided adjacent to and opposes the drainage port 441 of the pressure regulator 44. Therefore, the fuel that flows out of the drainage port 441 flows onto and over the heat radiation part 732. As such, the cooling plate 73 is cooled by heat exchange with the fuel to thereby cool the circuit board 72. Incidentally, the fuel poured on the heat radiation part 732 flows downward and is retained in the fuel tank 2, and the fuel is discharged toward the delivery pipe 4 by the fuel pump 40. The pressure regulator 44 corresponds to a "fuel outlet device."

Moreover, a sealant 74 (shown with cross hatching in FIGS. 1 and 3) is provided between a part of the cooling plate 73 that penetrates the case 71 and the case 71. The shape of the sealant 74 is a ring that encompasses the cooling plate 73. The sealant 74 is made of a material that swells due to the fuel more than the degree of swelling of the case 71. Also, the material of the sealant 74 is an elastic material. Moreover, the sealant 74 is provided between the case 71 and the cooling plate 73 in a state of elastic deformation. In one embodiment, the sealant 74 is made from an elastomer resin made by mixing rubber in a resin. For instance, the sealant 74 may be made out of epoxy resins in which hydrin, nitryl, or rubber of a fluorine system is blended and the like. The sealant 74 inhibits fuel from permeating into the case 71 as will be described.

As shown in FIG. 1, the cooling plate 73 extends transversely downward toward the fuel pump 40 from the flange 12. More specifically, the cooling plate 73 is substantially perpendicular to the opening 201 of the fuel tank 2 and the flange 12. As such, the cooling plate 73 is in a so-called longitudinal arrangement.

The FPC 70 also extends toward the fuel pump 40 from the flange 12, and is orientated such that the circuit board 72 is substantially perpendicular to the opening 201. As such, the FPC 70 is in a so-called longitudinal arrangement.

As shown in FIG. 3, when viewing downward along a longitudinal axis of the system (i.e., perpendicular to the opening 201 and flange 12), the fuel filter 42, the fuel pump 40, and the sender gage 51 are spaced from the cooling plate 73 so as not to interfere with the cooling plate 73. Since the cooling plate 73 is elongated and extends along the longitudinal direction, the system is relatively compact and can be mounted in a relatively small space.

Moreover, the broken circular line 421 shown in FIG. 3 is a virtual line representing an outer peripheral profile of the fuel filter 42, the fuel pump 40, the sender gauge 51, and the cooling plate 73 in combination. In other words, the broken line 421 is a virtual line of the outer boundary in the longitudinal direction of the fuel filter 42, the fuel pump 40, the sender gauge 51, and the cooling plate 73. A longitudinal projection of the cooling plate 73, the sender gauge 51, the fuel filter 42, the FPC 70, and the fuel pump 40 are also shown within (i.e., are encompassed by) the broken line 421.

The opening 201 of the fuel tank 2 is also shown in FIG. 3 for comparison with the outer peripheral profile represented by the broken line 421. As shown, the outer peripheral profile 421 is smaller than the opening 201 of the fuel tank 2. Therefore, when the pump module 10 is inserted longitudinally into the fuel tank 2 through the opening 201 and the flange 12 is attached to the fuel tank 2, the pump module 10 can easily be inserted into the fuel tank 2.

Thus, according to this first embodiment, since the cooling plate 73 is disposed in the fuel tank 2 and the cooling plate 73 exchanges heat with the fuel, cooling of the circuit board 72 of the FPC 70 is improved compared with the conventional structure of fin-based air cooling as described above. Also, the first embodiment is relatively compact for use even in a vehicle with relatively small clearance between the fuel tank 2 and the car body. In addition, according to this first embodiment, since the cooling plate 73 contacts the circuit board 72 of the FPC 70 and the fuel can be poured directly over the cooling plate 73, the cooling capability is improved compared with cooling structures described in JP-A-S62-35088 and JP-A-2001-99029.

Furthermore, according to this first embodiment, the cooling plate 73 directly contacts the circuit board 72 that is a source of heat generation. Therefore, the cooling capability can be improved compared with a structure in which the cooling plate 73 is made to contact only the case 71.

Here, the flange 12 supports the fuel discharge pipe 14, the fuel vapor outlet pipe 15, the fuel vapor control valve 17, and the electric connector 16, relatively little space is necessary for mounting the FPC 70 on the flange 12. Also, since in this first embodiment, the cooling plate 73 and the FPC 70 are in the longitudinal arrangement as described above, the flange 12 can also support the FPC 70 so that the fuel discharge pipe 14, the fuel vapor outlet pipe 15, the fuel vapor control valve 17, and the electric connector 16 do not interfere with the FPC 70.

In one embodiment, the metallic cooling plate 73 is insert molded with resin so as to be coupled with the resin-made case 71. When the case 71 swells due to the fuel, the cooling plate 73 is unlikely to swell. Therefore, a gap might be produced between the case 71 and the cooling plate 73, thereby allowing fuel to flow into the case 71. To address this problem, according to this first embodiment, the sealant 74 is provided between the cooling plate 73 and the case 71, and the sealant 74 swells to a much greater degree than the case 71.

Therefore, even if the case 71 deforms due to swelling in a direction moving away from the cooling plate 73, the gap between the case 71 and the cooling plate 73 is filled with the sealant 74 because the sealant 74 swells to a larger degree than the case 71. Moreover, the case 71 swells elastically as described above such that the sealant 74 restores its original state. Accordingly, the gap between the case 71 and the cooling plate 73 remains sealed by the sealant 74.

Second Embodiment

Figure 4:
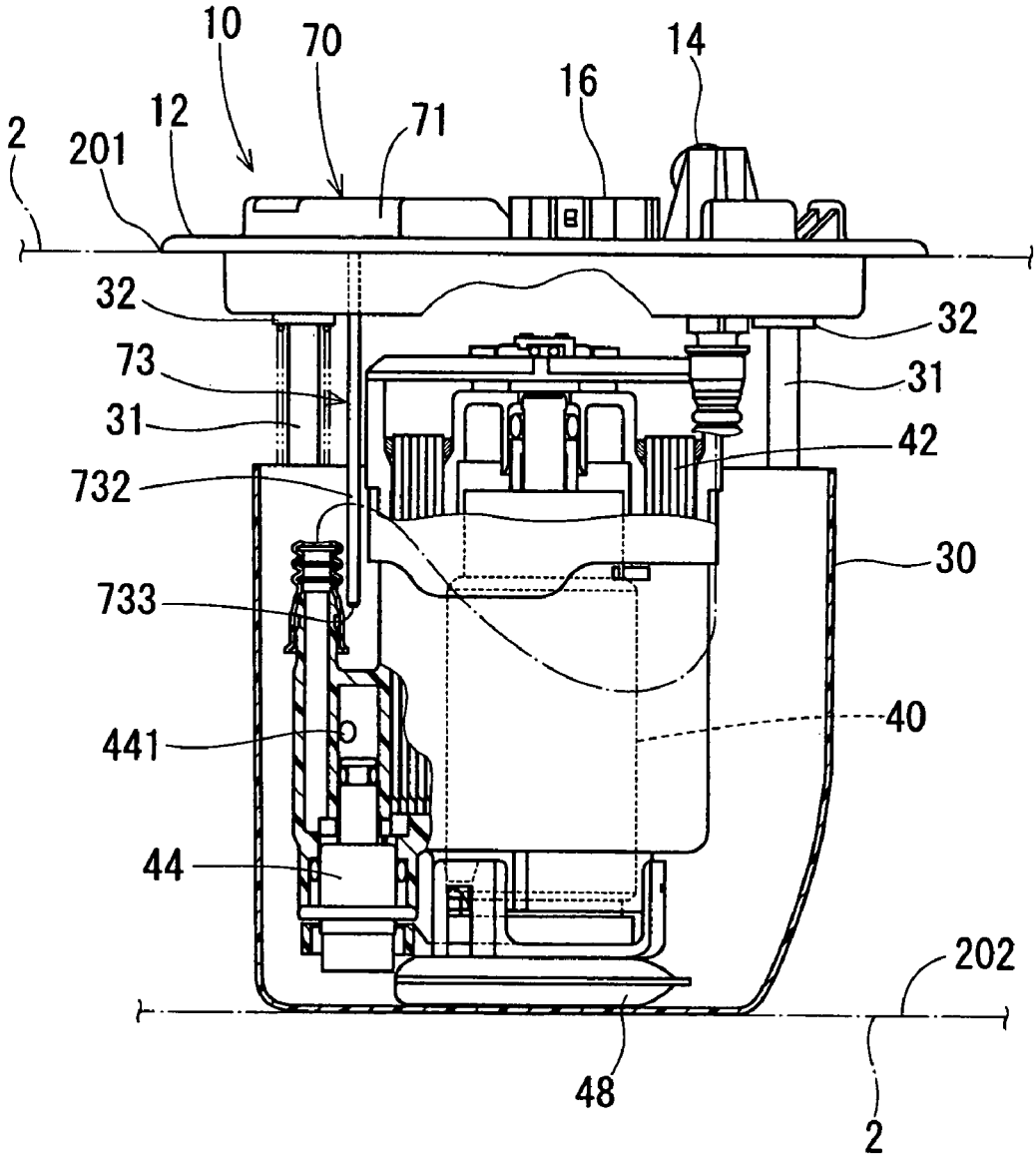
FIG. 4 is a front view of a second embodiment of a fuel supply system.
Figure 5:
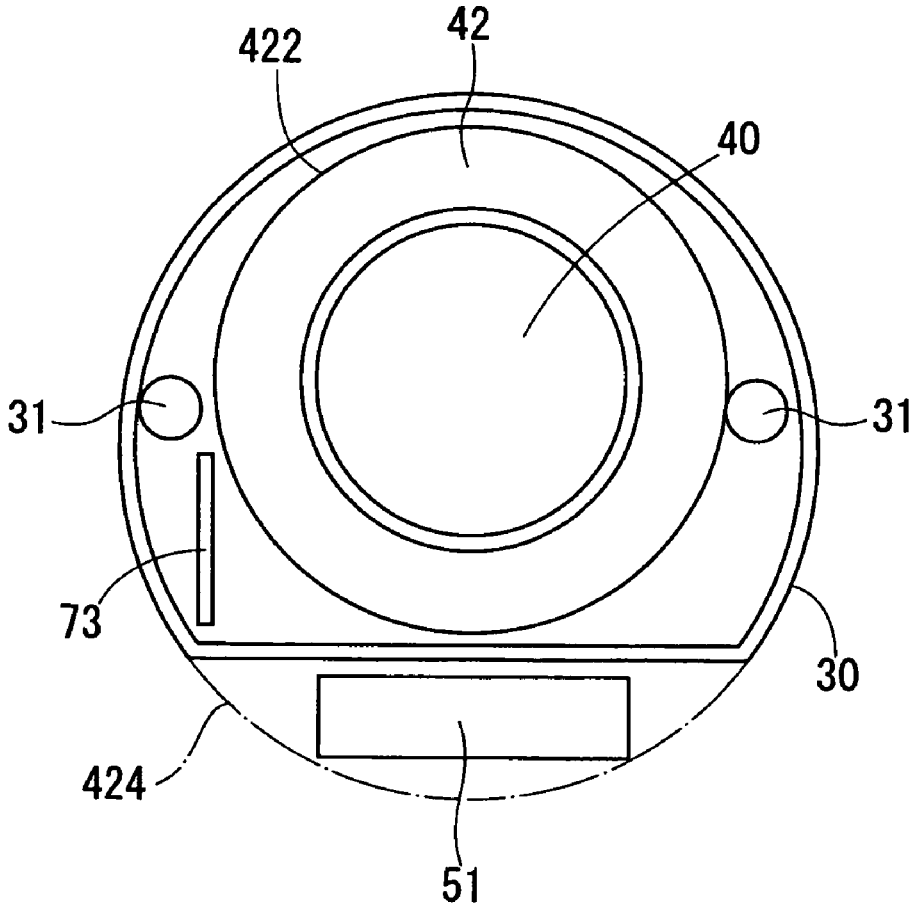
FIG. 5 is a longitudinal projection view of the fuel supply system of FIG. 1.

Referring now to FIGS. 4 and 5, a second embodiment is illustrated. Components that are similar to those of FIGS. 1-3 are indicated by corresponding reference numerals.

The pump module 10 in the second embodiment is equipped with a sub tank 30 placed inside the fuel tank 2. The fuel pump 40, the fuel filter 42, the suction filter 48, and the pressure regulator 44 are arranged in the sub tank 30. A point 733 of the cooling plate 73 is provided inside the sub tank 30.

The sub tank 30 is linked with the flange 12 by stays 31. The linkage will be explained concretely. The flange 12 is provided with a press-fit part 32 in which one end of each of the two stays 31 is press-fit on the sub-tank 30 side thereof. The other ends of the stays 31 are loosely inserted in support parts (not illustrated) formed on a peripheral side wall of the sub tank 30. Therefore, the sub tank 30 is slidable in the up/down direction relative to the flange 12.

The spring 33 is fit in a periphery of the stay 31 and provides a spring force in a direction in which the flange 12 and the sub tank 30 separate from each other. Therefore, in a state where the pump module 10 is coupled to the fuel tank 2, the sub tank 30 is pressed to a bottom inner wall 202 of the fuel tank 2 due to the spring force of the spring 33.

A jet pump (not shown) pumps fuel in the fuel tank 2 into the sub tank 30. Thus, even when fuel level is relatively low in the fuel tank 2, if there is as much fuel in the fuel tank 2 as fills the sub tank 30, fuel is pumped to the sub tank 30, and accordingly fuel in the sub tank 30 contacts the cooling plate 73.

Although in the first embodiment described above, the FPC 70 is disposed under the flange 12, in this second embodiment the FPC 70 is disposed above the flange 12 (on the other side of the flange 12 to the sub tank 30), and the FPC 70 is provided outside the fuel tank 2. The FPC 70 according to this second embodiment is disposed to be in an orientation in which the circuit board 72 thereof is substantially parallel to the flange 12. As such, the FPC 70 is disposed in a so-called transverse arrangement.

FIG. 5 shows a longitudinal projection of the system similar to FIG. 3. As shown in FIG. 5, the fuel gauge 50 is attached on the peripheral wall of the sub tank 30. Moreover, while the fuel filter 42 according to the first embodiment described above is in the form of a semicircle as shown in FIG. 3, the fuel filter 42 according to this second embodiment is substantially in the form of a ring as shown in FIG. 5. The fuel filter 42 has a filter case 422 made of a resin for housing a filter, and is one embodiment of a "support member" described below in the claims.

As shown in FIG. 5, when viewing through the opening 201 in the longitudinal direction, the projection of the fuel filter 42, the fuel pump 40, the sender gauge 51, and the stay 31 are arranged so as to be spaced from the cooling plate 73. Therefore, even if the cooling plate 73 is relatively long, the system is relatively compact and can be mounted in relatively small spaces.

Thus, in this embodiment, the cooling plate 73 contacts the circuit board 72 of the FPC 70 and is disposed in the sub tank 30. Thus, the cooling plate 73 continually exchanges heat with the fuel in the sub tank 30. Therefore, regardless of the clearance between the fuel tank 2 and the car body, the circuit board 72 of the FPC 70 can be sufficiently cooled compared with the conventional structure of air cooling type equipped with a cooling fin. Furthermore, since the cooling plate 73 contacts the circuit board 72 of the FPC 70 and the cooling plate 73 directly contacts the fuel, the cooling capability is improved compared with the cooling structure described in JP-A-S62-35088 and JP-A-2001-99029.

Third Embodiment

Referring now to FIG. 6, a third embodiment is shown. Components that are similar to the embodiments described above are indicated with corresponding reference numerals.

Figure 6A:
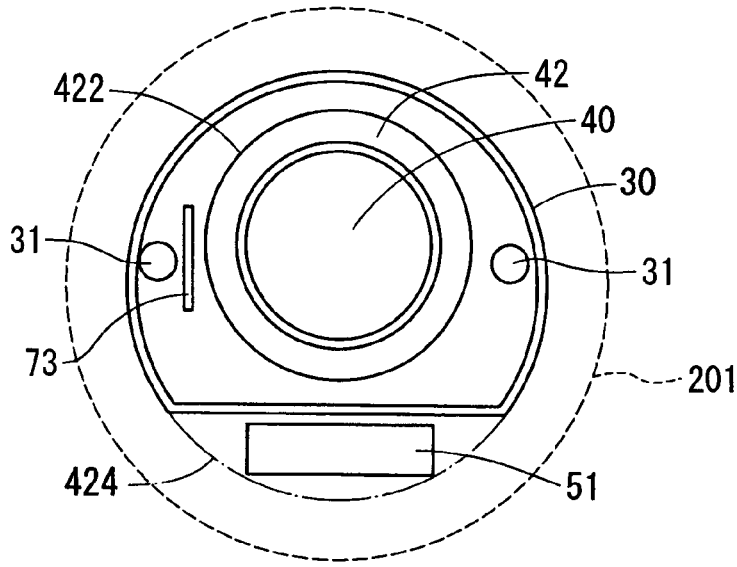
FIGS. 6A, 6B, and 6C are longitudinal projection views of a third embodiment of the fuel supply system.
Figure 6B:
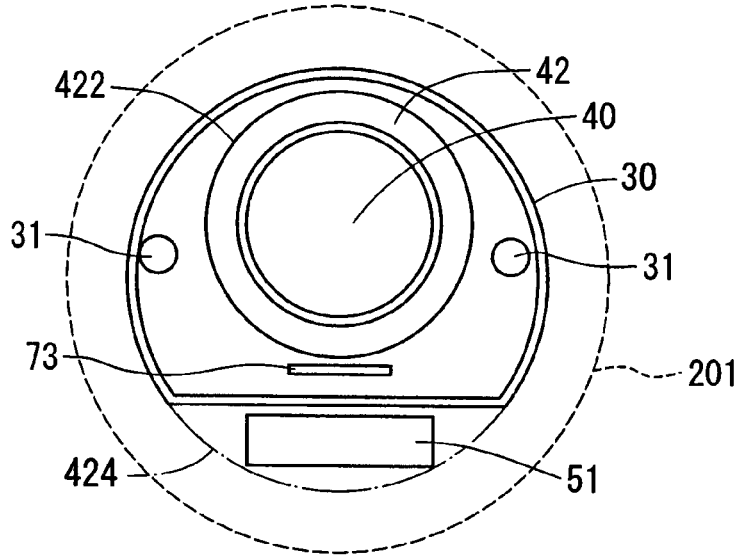
Figure 6C:
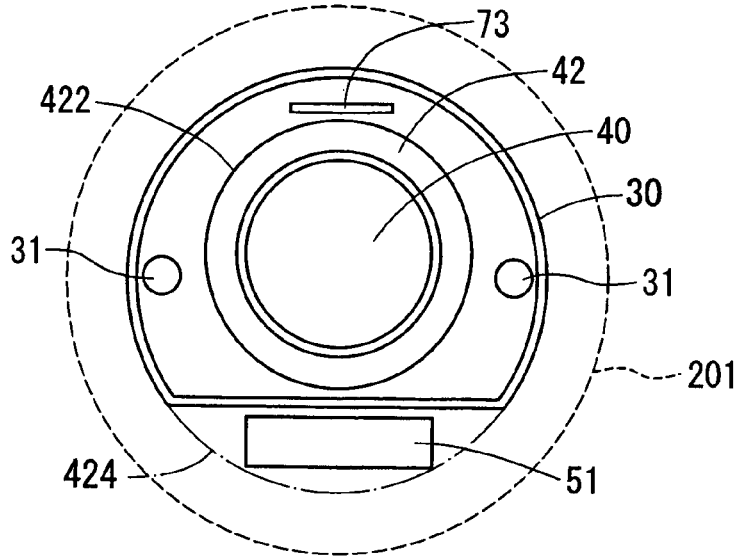

In this third embodiment, the position of the cooling plate 73 is altered from the second embodiment described above. Three patterns of FIGS. 6A, 6B, and 6C are illustrated as examples of the position of the cooling plate 73 and are explained in greater detail below. Incidentally, the third embodiment is the same as the second embodiment in that when viewing longitudinally downward through the opening 201, the position of the cooling plate 73 is such that the cooling plate 73 is spaced from the filter case 422 as the support member, the stay 31, and the fuel pump 40.

The cooling plate 73 shown in FIG. 6A is disposed between the filter case 422 and the stay 31 in the above-mentioned space. The cooling plate 73 shown in FIG. 6B is disposed between the sender gage 51 and the filter case 422 in the above-mentioned space. The cooling plate 73 shown in FIG. 6C is disposed on the opposite side of the filter case 422 to the sender gauge 51 in the above-mentioned space.

Incidentally, a broken line 424 shown in FIGS. 6A-6C is a virtual line representing an outer peripheral profile of the subtank 30 and the sender gauge 51 in combination. The opening 201 of the fuel tank 2 is also shown for comparison. As shown, the outer peripheral profile 424 is smaller than the opening 201. Therefore, when the pump module 10 is inserted longitudinally into the fuel tank 2 through the opening 201 and the flange 12 is attached to the fuel tank 2, the pump module 10 can easily be inserted into the inside of the fuel tank 2.

According to this third embodiment, when viewing a longitudinal projection of the cooling plate 73, the filter case 422, the stay 31, and the fuel pump 40 through the opening 201, the cooling plate 73 is spaced from the filter case 422, the stay 31, and the fuel pump 40. Therefore, regardless of the length of the cooling plate 73, the cooling plate 73 is spaced from the filter case 422, the stay 31, and the fuel pump 40. However, the system is relatively compact and can be mounted in a relatively small space in the vehicle.

Other Embodiment

In the first embodiment described above, the pressure regulator 44 is described as a "fuel outlet device". However, the fuel outlet device is not limited to the pressure regulator 44. For example, in a fuel supply system equipped with return pipe arrangement that returns surplus fuel in the delivery pipe 4 to the fuel tank 2, the return pipe arrangement may function as a fuel outlet device by pouring the fuel returned to the fuel tank 2 through the return pipe arrangement over the cooling plate 73.

As another example of a "fuel outlet device," there can be further enumerated means for discharging, toward the cooling plate 73, a portion of the fuel being discharged toward the delivery pipe 4 from the fuel pump 40. However, in this case, power consumption of the fuel pump 40 may be increased by an amount of electricity required to discharge the fuel toward the cooling plate 73. On the contrary, when the pressure regulator 44 according to the first embodiment or the above-mentioned return pipe arrangement is the fuel outlet device, the problem of increase in power consumption described above can be avoided.

In the pump module 10 according to the first embodiment described above, the FPC 70 disposed in the longitudinal arrangement may be disposed in the transverse arrangement. In the pump module 10 by the second embodiment described above, the FPC 70 disposed in the transverse arrangement may be in the longitudinal arrangement. Moreover, although the FPC 70 according to the first embodiment is disposed so that the circuit board 72 is substantially perpendicular to the opening 201, it is suitable that the FPC 70 is disposed to be in an orientation in which the circuit board 72 crosses the opening 201. Also, an orientation of the FPC 70 shown in FIG. 1 may be inclined at an acute angle relative to the up/down direction of FIG. 1 (to at least one of the right-left direction and the sheet vertical direction of FIG. 1).

The resin-made case 71 of the FPC 70 may have a structure to be attached on the flange 12 by fixing means, such as snap fit, or may be integral with the flange 12 using a resin.

Although in each embodiment described above, the FPC 70 is coupled to the flange 12 to form a constitutional component of the pump module 10, the FPC 70 may be installed on a location other than the flange 12, and the FPC 70 may be made as a separate member from the pump module 10. Also, although the flange 12 by the first embodiment described above is made of the resin, it may be made of a metal.

In each embodiment described above, the cooling plate 73 is disposed to be in the orientation in which the plate face of the cooling plate 73 is substantially perpendicular to the opening 201. However, it is suitable that the cooling plate 73 is disposed to be in an orientation in which the plate face thereof crosses the aperture of the opening 201. For example, the orientation of the cooling plate 73 shown in FIGS. 1 and 3 may be inclined at an acute angle relative to the up/down direction of FIGS. 1 and 3 (to at least one of the right-left direction and the sheet vertical direction of FIGS. 1 and 3).

As in the foregoing, this invention is not limited to the above-mentioned embodiments, and can be applied to various fuel supply systems and the like, as possible embodiments, without departing from the spirit and scope thereof.

While only the selected preferred embodiments have been chosen to illustrate the present invention, it will be apparent to those skilled in the art from this disclosure that various changes and modifications can be made therein without departing from the scope of the invention as defined in the appended claims. Furthermore, the foregoing description of the preferred embodiments according to the present invention is provided for illustration only, and not for the purpose of limiting the invention as defined by the appended claims and their equivalents.

What is claimed is:

1. A fuel supply system for supplying fuel in a fuel tank to an internal combustion engine, comprising:

an electric fuel pump for increasing a pressure of the fuel and moving the fuel;

a controller for controlling operations of the fuel pump;

a cooling plate that is disposed in the fuel tank and contacts the controller, the cooling plate for cooling the controller;

a fuel outlet device that allows for a flow of the fuel onto the cooling plate for heat exchange between the fuel and the cooling plate;

a lid member for covering an opening of the fuel tank, the controller coupled to the lid member; and a support member for supporting the fuel pump;

wherein when viewing a longitudinal projection of the cooling plate, the support member, and the fuel pump through the opening, the cooling plate is coupled to the lid member so as to extend transversely downward with respect to the opening of the fuel tank, the cooling plate is spaced from the support member and the fuel pump, and the cooling plate extends downwardly so as to come into direct contact with the fuel.

2. The fuel supply system according to claim 1, wherein the fuel outlet device is a pressure regulator that adjusts a discharge pressure of the fuel pump by draining the fuel onto the cooling plate when the discharge pressure of the fuel pump exceeds a predetermined pressure.

3. The fuel supply system according to claim 1, further comprising:

a lid member for covering an opening of the fuel tank; and the controller is coupled to the lid member so as to be encompassed by a longitudinal projection of the opening of the fuel tank.

4. The fuel supply system according to claim 1, wherein the controller includes a circuit board and a case for housing the circuit board, and the cooling plate has a contact part inside the case and contacts the circuit board and a radiation part outside the case.

5. The fuel supply system according to claim 4, wherein the case is made of a resin, the cooling plate is made of a metal, a sealant is provided between the cooling plate and the case, the sealant is such that a degree of swelling caused by the fuel is greater than that of the case, and the sealant is elastically deformable.

6. A fuel supply system for supplying fuel in a fuel tank to an internal combustion engine, comprising:

a sub tank disposed in the fuel tank;

a fuel pump that is disposed in the sub tank, increases a pressure of the fuel, and moves the fuel;

a controller for controlling operations of the fuel pump;

a cooling plate that is disposed in the sub tank and contacts the controller, the cooling plate for cooling the controller;

a lid member for covering an opening of the fuel tank, the controller coupled to the lid member;

a stay for coupling the lid member and the sub tank; and a support member for supporting the fuel pump in the sub tank;

wherein when viewing a longitudinal projection of the cooling plate, the support member, the stay, and the fuel pump through the opening, the cooling plate is coupled to the lid member so as to extend transversely downward with respect to the opening of the fuel tank, the cooling plate is spaced from the support member, the stay, and the fuel pump and the cooling plate extends downwardly so as to come into direct contact with the fuel.

7. The fuel supply system according to claim 6, further comprising:

a lid member for covering an opening of the fuel tank; and the controller is coupled to the lid member so as to be encompassed by a longitudinal projection of the opening of the fuel tank.

8. The fuel supply system according to claim 6, wherein the controller includes a circuit board and a case for housing the circuit board, and the cooling plate has a contact part inside the case and contacts the circuit board and a radiation part outside the case.

9. The fuel supply system according to claim 8, wherein the case is made of a resin, the cooling plate is made of a metal, a sealant is provided between the cooling plate and the case, the sealant is such that a degree of swelling caused by the fuel is greater than that of the case, and the sealant is elastically deformable.

10. A fuel supply system for supplying fuel in a fuel tank to an internal combustion engine, comprising:

an electric fuel pump for increasing a pressure of the fuel and moving the fuel;

a controller for controlling operations of the fuel pump;

a cooling plate that is disposed in the fuel tank and contacts the controller, the cooling plate for cooling the controller; and a fuel outlet device that allows for a flow of the fuel onto the cooling plate for heat exchange between the fuel and the cooling plate, wherein:

the controller includes a circuit board and a case for housing the circuit board, the cooling plate has a contact part inside the case and contacts the circuit board and a radiation part outside the case, wherein the case is made of a resin, the cooling plate is made of a metal, a sealant is provided between the cooling plate and the case, the sealant is such that a degree of swelling caused by the fuel is greater than that of the case, and the sealant is elastically deformable.

* * * * *